US010408551B2

(12) United States Patent
Zhao et al.

(10) Patent No.: US 10,408,551 B2
(45) Date of Patent: Sep. 10, 2019

(54) COLUMNAR COOLING TUBE BUNDLE WITH WEDGE-SHAPED GAP

(71) Applicant: SHANDONG UNIVERSITY, Jinan, Shandong (CN)

(72) Inventors: Yuanbin Zhao, Jinan (CN); Yujie Yang, Jinan (CN)

(73) Assignee: SHANDONG UNIVERSITY, Shandong (CN)

( * ) Notice: Subject to any disclaimer, the term of this patent is extended or adjusted under 35 U.S.C. 154(b) by 0 days.

(21) Appl. No.: 15/568,788

(22) PCT Filed: May 18, 2015

(86) PCT No.: PCT/CN2015/079210

§ 371 (c)(1),
(2) Date: Oct. 23, 2017

(87) PCT Pub. No.: WO2016/169076

PCT Pub. Date: Oct. 27, 2016

(65) Prior Publication Data

US 2018/0128558 A1 May 10, 2018

(30) Foreign Application Priority Data

Apr. 23, 2015 (CN) ..... 2015 1 0201859
Apr. 23, 2015 (CN) ..... 2015 2 0258395 U

(51) Int. Cl.
*F28F 1/00* (2006.01)
*F28F 27/00* (2006.01)
(Continued)

(52) U.S. Cl.
CPC ..... *F28F 27/003* (2013.01); *F28B 1/06* (2013.01); *F28C 1/00* (2013.01); *F28F 1/00* (2013.01);
(Continued)

(58) Field of Classification Search
CPC .. F28F 27/003; F28F 9/013; F28F 1/40; F28F 1/003; F28F 1/00; F28C 1/00; F28C 2001/006; F28B 1/06
(Continued)

(56) References Cited

U.S. PATENT DOCUMENTS 2,205,292 A * 6/1940 Howard ..... F28B 1/06 165/114
2,608,388 A * 8/1952 Miller ..... F28F 9/0138 122/493
(Continued)

FOREIGN PATENT DOCUMENTS

CN 202329263 U 7/2012
CN 103424007 A 12/2013
DE 2 457 648 A1 6/1975

OTHER PUBLICATIONS

Jan. 26, 2016 International Search Report issued in International Patent Application No. PCT/CN2015/079210.

*Primary Examiner* — Claire E Rojohn, III
(74) *Attorney, Agent, or Firm* — Oliff PLC

(57) ABSTRACT

A columnar cooling tube bundle with a wedge-shaped gap, including two finned tube bundles, which intersect at one side with a set angle and open at the other and form a wedge-shaped gap; with the intersection as an origin, a distance l extends to the opening side, the bundles share fins within 0-l, wherein l is no more than half the distance between the two sides. When air inflows vertically to the louver of the cooling unit, fresh air is directly introduced into the cooling tube bundle to improve the average heat transfer temperature difference of the cooling tube bundle and intensify the heat transfer; when air inflows obliquely, it impacts the inner space of the cooling unit, therefore the low-speed eddy area is reduced, both the cooling performance of the tube bundle and cooling unit overall is
(Continued)

improved, and the cooling performance of the dry cooling tower is improved.

9 Claims, 4 Drawing Sheets

(51) Int. Cl.
*F28C 1/00* (2006.01)
*F28B 1/06* (2006.01)
*F28F 1/40* (2006.01)
*F28F 9/013* (2006.01)

(52) U.S. Cl.
CPC ..... *F28F 1/003* (2013.01); *F28F 1/40* (2013.01); *F28F 9/013* (2013.01); *F28C 2001/006* (2013.01)

(58) Field of Classification Search
USPC ..... 165/177
See application file for complete search history.

(56) References Cited

U.S. PATENT DOCUMENTS 3,212,288 A * 10/1965 Herbert ..... F24F 13/22 165/135
3,338,052 A * 8/1967 Holden ..... F01K 11/02 165/114
3,384,165 A * 5/1968 Mathews ..... F28B 1/06 165/122
3,400,917 A * 9/1968 Richards ..... E04H 5/12 165/122
3,519,068 A * 7/1970 Billington ..... F28B 1/06 165/122
3,612,172 A * 10/1971 Dohnt ..... F28B 1/06 165/111
3,814,177 A * 6/1974 Harris ..... F28B 1/06 165/110
3,888,305 A * 6/1975 Gerz ..... F28B 1/06 165/113
3,915,223 A * 10/1975 Kelp ..... F28B 1/06 165/111
3,918,518 A * 11/1975 James ..... E04H 5/12 165/122
3,942,588 A * 3/1976 Schoonnnan ..... F28B 1/06 165/129
3,976,127 A * 8/1976 Harris ..... F28B 1/06 165/125
4,020,899 A * 5/1977 Langerock ..... F28B 1/06 165/110
4,029,144 A * 6/1977 Harris ..... F28B 1/06 165/124
4,168,742 A * 9/1979 Kluppel ..... F28B 1/06 165/114
D255,155 S * 5/1980 Meurer ..... D23/209
4,202,405 A * 5/1980 Berg ..... F28B 1/06 165/110
4,243,095 A * 1/1981 Kosten ..... F28B 1/06 165/101
4,282,696 A * 8/1981 Michel ..... E04H 5/12 261/DIG. 11
4,446,914 A * 5/1984 Russell ..... F28B 1/06 165/129
4,513,813 A * 4/1985 Zanobini ..... F28B 1/06 165/110
4,550,570 A * 11/1985 Trage ..... F28B 1/06 165/900
4,690,207 A * 9/1987 Trage ..... F28B 1/06 165/113
4,691,764 A * 9/1987 Durst ..... F28D 9/0018 165/165
4,926,931 A * 5/1990 Larinoff ..... F28B 1/06 165/111
5,301,746 A * 4/1994 Trage ..... F28B 1/06 165/113
6,588,499 B1 * 7/2003 Fahlsing ..... F28B 1/06 165/111
9,429,045 B2 * 8/2016 Bruckner ..... F01K 23/108
10,024,600 B2 * 7/2018 Bugler ..... F28B 1/06
10,060,687 B2 * 8/2018 Wu ..... F28D 1/0435
2010/0263840 A1 * 10/2010 Nobel ..... F28B 1/06 165/120
2010/0276129 A1 * 11/2010 Bodas ..... F01K 9/00 165/157
2013/0292103 A1 * 11/2013 Eindhoven ..... F28B 1/06 165/173
2013/0312932 A1 * 11/2013 Vouche ..... F28B 1/06 165/67
2014/0335777 A1 * 11/2014 Szabo ..... F28B 1/06 454/309
2014/0367243 A1 * 12/2014 Kroger ..... F28B 1/06 202/161
2015/0345166 A1 * 12/2015 Quickelberghe ..... E04H 5/12 165/68
2017/0051980 A1 * 2/2017 Singh ..... F28F 9/0243
2017/0051981 A1 * 2/2017 Singh ..... F28B 1/06
2018/0128558 A1 * 5/2018 Zhao ..... F28B 1/06

* cited by examiner

COLUMNAR COOLING TUBE BUNDLE WITH WEDGE-SHAPED GAP

FIELD OF THE INVENTION

The present invention belongs to the field of indirect air cooling of thermal/nuclear power stations, and particularly relates to a columnar cooling tube bundle with a wedge-shaped gap.

BACKGROUND OF THE INVENTION

A natural draft dry cooling tower has excellent water-saving and energy-saving properties with zero water consumption and zero draught fan power consumption, and thus has gradually become a main cooling device for the circulating water of a thermal power generating unit in the Northwest, North China and other areas with dry and rare water. The natural draft dry cooling tower, hereinafter referred to as a dry cooling tower, is composed of cooling radiators and a towerbody, wherein the radiators are composed of finned tube bundles. The finned tube bundles below the tower body can be either circumferentially arranged around tower to form cooling delta units, or horizontally arranged below the tower body to form A-shaped framework cooling units.

In the dry cooling tower with vertical radiators outside tower, the cooling delta unit is composed of two cooling columns connected in parallel, each cooling column is composed of 3-4 cooling tube bundles connected in series, and the conventional cooling tube bundle is a finned tube bundle with 4 or 6 rows of base tubes. In the dry cooling tower with horizontal radiators inside tower, the A-shaped framework cooling unit is composed of two cooling columns connected in parallel, and each cooling column includes 2-4 cooling tube bundles connected in series.

The circulating water flows in the finned tube bundles of the dry cooling tower, so as to transmit the heat to the ambient air flowing by the fins in a convective heat transfer manner. The existing research shows that the ambient natural crosswind has a direct influence on the aerodynamic field around tower bottom air inlet and the aerodynamic field around tower top air outlet, thereby reducing the heat transfer performance of the cooling tube bundles at tower lateral and deteriorating the overall cooling performance of the dry cooling tower.

FIG. 1 shows an existing dry cooling tower with vertical cooling delta units in an indirect air cooling power station, wherein the radiator 1 formed by cooling delta units is vertically arranged outside the bottom air inlet of the tower body 2. FIG. 2 shows a schematic arrangement diagram of an overall cross-section view of the existing cooling delta unit radiators around tower. As can be seen from FIG. 2, the radiator can be divided into 5 cooling sectors along the half tower circumference, and the whole tower has 10 sectors in total. The cooling sectors are marked clockwise in sequence along the half tower circumference: the first sector 3, covering the range of sector angle θ from 0° to 36°; the second sector 4, covering the range of sector angle θ from 36° to 72°; the third sector 5, covering the range of sector angle θ from 72° to 108°; the fourth sector 6, covering the range of sector angle θ from 108° to 144°; and the fifth sector 7, covering the range of sector angle θ from 144° to 180°. FIG. 3 shows a structural schematic diagram of the cross section of one existing cooling delta unit formed by two cooling columns. The cooling delta unit includes the first cooling column 8 and the second cooling column 9, which have the same structure and intersect with each other at their inner side end vertexes with an included angle from 40° to 60°. The outer non-intersecting sides of the two cooling columns are open to form the main air inlet 10 of the cooling delta unit, and a louver is arranged at the air inlet for controlling the air so as to prevent the cooling column tube bundle from freezing and cracking in winter.

In the absence of ambient natural crosswind, nearly all the ambient air 11 can fluently flow into the cooling delta unit along tower radial direction, and flow through the first cooling column 8 and the second cooling column 9 at the same time, so as to complete heat transfer. The air flow field structure in the cooling delta unit is symmetrical about the centerline of the cooling delta unit, and then the cooling performances of the first cooling column 8 and the second cooling column 9 are the same. However, as far as the multiple row finned tube bundles in the same cooling tube bundle of a cooling column, the finned tubes close to the louver air inlet side firstly exchange heat with the incoming flow air, so that the air temperature corresponding to the finned tubes on the downstream is raised, resulting in that the heat dissipation of the finned tubes away from the louver air inlet side is insufficient.

During the actual operation of dry cooling tower, the ambient natural crosswind always exists and causes adverse effect on the cooling performance of dry cooling tower. In order to ensure the cooling performance of dry cooling tower, the design ambient crosswind speed is usually 4 m/s or 6 m/s for the dry cooling tower. FIG. 4 shows the aerodynamic field around the cross section of one cooling delta unit in the third sector at tower lateral under the impact of 4 m/s ambient crosswind. With the influence of the 4 m/s ambient crosswind as an example, as can be seen from FIG. 4, the 4 m/s ambient crosswind causes a larger circumferential speed of the air at tower lateral. Then, for the cooling delta unit at tower lateral, the air inflow direction at the delta air inlet, namely, the louver location, deviates from the symmetry plane of the cooling unit for a certain angle of $\theta_d$. Meanwhile, a large eddy is caused on the air inlet side of the first cooling column 8 of the cooling delta unit, which will certainly reduce the ventilation quantity of the first cooling column 8, weaken the cooling performance of the first cooling column 8, and eventually result in the fact that the water temperature flowing out of the first cooling column 8 is obviously increased.

Therefore, under the ambient crosswind condition, how to reduce the adverse effects of low-speed eddy areas in the cooling delta unit sat tower lateral, increase the ventilation quantity of the cooling unit, reduce or even eliminate the low-speed eddy area in the cooling unit, intensify the cooling performance of cooling tube bundles in the cooling columns and then improve the overall cooling performance of the cooling unit and the dry cooling tower have become urgent problems to be solved.

SUMMARY OF THE INVENTION

The present invention provides a columnar cooling tube bundle with a wedge-shaped gap used for dry cooling tower, in order to overcome the shortcomings in the prior art. By the wedge-shaped gap at the outer end wall of the columnar cooling tube bundle, the air inlet of the cooling unit for the dry cooling tower is optimized. In the presence of ambient crosswind, the incoming flow air from the wedge-shaped gap at the outer end wall of the columnar cooling tube bundle directly impacts the inner aerodynamic field inside the cooling unit, therefore the low-speed air flow area in the cooling unit at tower lateral can be effectively reduced or even eliminated. Thus, both the cooling performance of the cooling column on one side of the cooling unit and the overall cooling performance of the cooling unit can be improved. In the absence of the ambient crosswind, the incoming flow air from the wedge-shaped gap at the outer end wall of the columnar cooling tube bundle can increase the internal ventilation in the cooling tube bundle, amplify the average heat transfer temperature difference between the air and water on the two sides of finned tube bundles, and then intensify the heat transfer performance of the cooling tube bundle.

In order to achieve the above objectives, the present invention adopts the following technical solutions:

A columnar cooling tube bundle with a wedge-shaped gap includes two finned tube bundles, which intersect with each other at one side with a set included angle and open at the other side, and then form a wedge-shaped gap between the finned tube bundles.

Further, the two finned tube bundles are symmetrically arranged.

Further, when the two finned tube bundles are vertically arranged, one of the two finned tube bundles is the upstream side tube bundle, and the other of the two finned tube bundles is the downstream side tube bundle.

Further, when the two finned tube bundles are horizontally arranged, one of tithe first single-pass tube bundle, and the other of the two finned tube bundles is the second single-pass tube bundle. Further, the included angle β between the two finned tube bundles is 0° to 10°.

Further, referring to the ambient crosswind speed and the relative position of the cooling unit composed of the columnar cooling tube bundles with respect to the ambient crosswind direction, the included angle β formed by the two finned tube bundles can be preferably 3°, 4°, 5°, 6°, 7°, 8°, 9° and 10° in sequence.

Further, with the intersection point between the end walls of the two finned tube bundles on the intersection side as the original point, a certain distance l is extended along the finned tube bundles toward the end walls on the opening side, and the distance from the original point to the end walls of the two finned tube bundles on the opening side is L. The two finned tube bundles share fins within 0-l, wherein $0<l\leq\frac{1}{2}L$ is satisfied. Referring to the ambient crosswind speed and the relative position of the cooling unit composed of the columnar cooling tube bundles with respect to the ambient crosswind direction, the distance l of the shared fins can be preferably ⅛ L, ¼ L, ⅜ L and ½ L in sequence.

Further, the tube rows in the finned tube bundles are arranged in a staggered mode or an in-line mode.

Further, the tube rows in the finned tube bundles can be n rows, wherein $4\geq n\geq 1$, and n is an integer. In real arrangement, a louver is set at the air inlet of the wedge-shaped gap at the end walls of the two finned tube bundles on the opening side.

Compared with the prior art, the present invention has the following beneficial effects:

1) with respect to the dry cooling tower with delta radiators arranged vertically outside the tower, in the absence of ambient crosswind, the incoming flow air from the wedge-shaped gap at the end wall of the opening side of the columnar cooling tube bundle can increase the internal ventilation of the cooling tube bundles, amplify the average heat transfer temperature difference between the air and water on the two sides of finned tube bundles, and then intensify the heat transfer performance of the cooling tube bundle;

2) with respect to the dry cooling tower with delta radiators arranged vertically outside the tower, in the presence of ambient crosswind, for the cooling units of the dry cooling tower at tower lateral, the incoming flow air from the wedge-shaped gap at the end wall of the opening side of the columnar cooling tube bundle can directly impact the inner space of the cooling unit at tower lateral, therefore the adverse effects of low-speed air eddy in the cooling unit at tower lateral can be effectively reduced or even eliminated, and both the cooling performance of the cooling column on one side of the cooling unit and the overall cooling performance of the cooling unit can be improved;

3) with respect to the dry cooling tower with delta radiators arranged vertically outside the tower, in the presence of ambient crosswind, for the cooling units on a windward side and a leeward side of the dry cooling tower, when air flows into the cooling units, the incoming flow air from the wedge-shaped gap at the end wall of the opening side of the columnar cooling tube bundle can increase the internal ventilation of the cooling tube bundle, amplify the average heat transfer temperature difference between the air and water on the two sides of finned tube bundles, and then intensify the heat transfer performance of the cooling tube bundle;

4) with respect to the dry cooling tower with A-shaped framework radiators horizontally arranged below the tower body, the wedge-shaped gap at the end wall of the opening side of the columnar cooling tube bundle can avoid the formation of low-speed air eddy in the cooling units, and can increase the internal ventilation of the cooling tube bundle, amplify the average heat transfer temperature difference between the air and water on the two sides of finned tube bundles, and then intensify the heat transfer performance of the cooling tube bundle; and 5) the two finned tube bundles forming the columnar cooling tube bundle with the wedge-shaped gap form the small-size wedge-shaped gap on the opening side, under the action of ambient crosswind in different wind directions, the finned tube bundles on the two sides of the wedge-shaped gap can function to shield and guide air for each other to a certain extent, effectively inhibit eddy formation in the small-size space of the wedge-shaped gap, and ensure high efficiency of the columnar cooling tube bundle with the wedge-shaped gap under ambient crosswind indifferent wind directions.

Reference signs: 1. radiator, 2. tower body, 3. first sector, 4. second sector, 5. third sector, 6. fourth sector, 7 fifth sector, 8. first cooling column, 9. second cooling column, 10. main air inlet, 11. air, 12. wedge-shaped gap, 13. first finned tube bundle, 14. second finned tube bundle, 15. upstream side tube bundle, 16. downstream side tube bundle, 17. first single-pass tube bundle, 18. second single-pass tube bundle, 19. first novel cooling column, and 20. second novel cooling column.

DETAILED DESCRIPTION OF THE EMBODIMENTS

The present invention will be further illustrated below in combination with drawings and embodiments.

Figure 1:
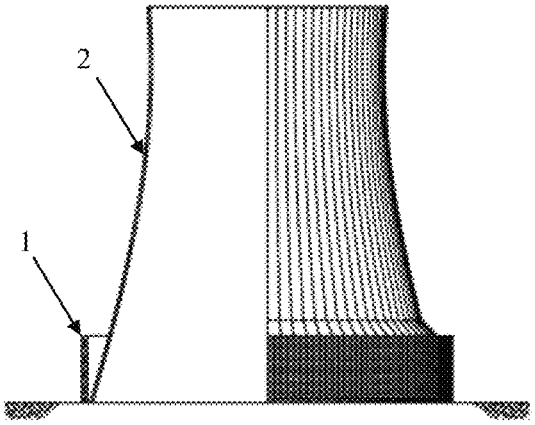
Fig. 1 RELATED ART
FIG. 1 shows an existing dry cooling tower in an indirect cooling power station.
Figure 2:
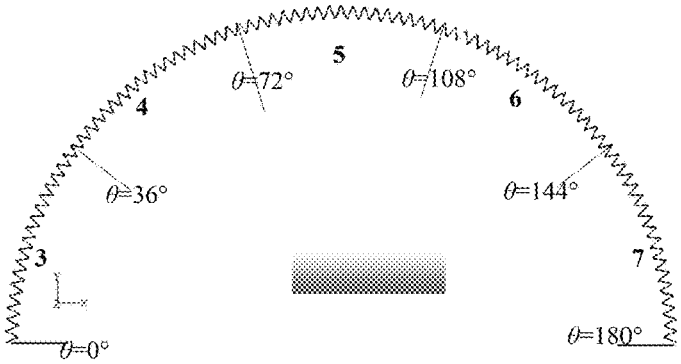
Fig. 2 RELATED ART
FIG. 2 is a schematic arrangement diagram of an overall cross-section view of the existing cooling delta unit radiators around tower.
Figure 3:
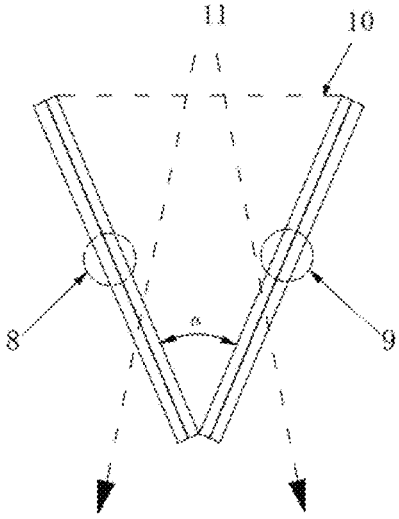
Fig. 3 RELATED ART
FIG. 3 is a structural schematic diagram of an existing cooling delta unit of a dry cooling tower.
Figure 4:
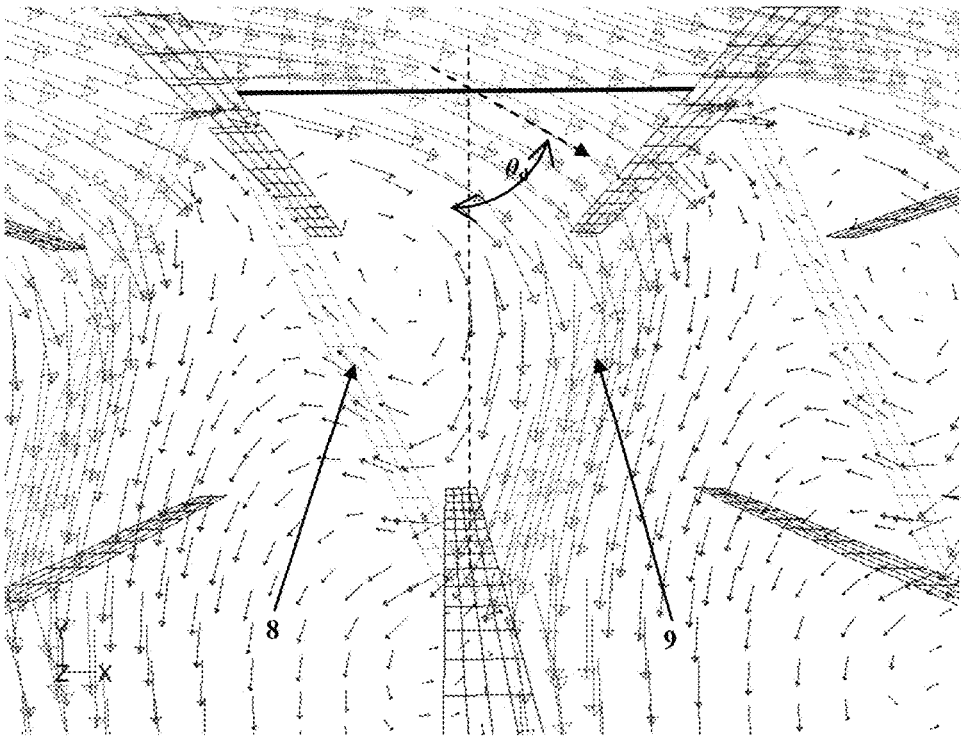
Fig. 4 RELATED ART
FIG. 4 is a schematic diagram of an existing cooling delta unit in a third sector of a dry cooling tower at tower lateral under the impact of 4 m/s design wind speed.
Figure 5:
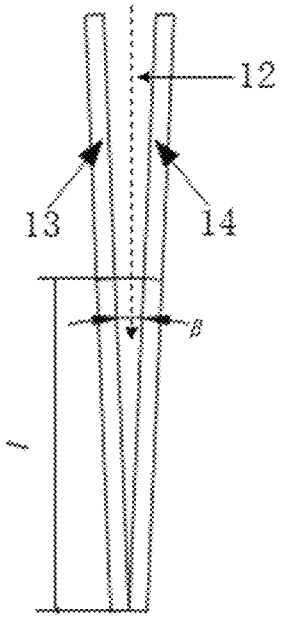
FIG. 5 shows a columnar cooling tube bundle with a wedge-shaped gap.

FIG. 5 shows a columnar cooling tube bundle with a wedge-shaped gap, including two finned tube bundles, namely a first finned tube bundle 13 and a second finned tube bundle 14, which intersect with each other at one end with a set included angle β of 0° to 10°. The first finned tube bundle 13 and the second finned tube bundle 14 have the same structure, intersect with each other at the end walls on one side, open at the end walls on the other side, and form a wedge-shaped gap 12 between the two finned tube bundles.

With the intersection point of the first finned tube bundle 13 and the second finned tube bundle 14 on one side as an original point, a certain distance l is extended toward the other side, and then the first finned tube bundle 13 and the second finned tube bundle 14 share fins within 0-l, wherein 0<l<½ L, and the distance from the original point to the end points of the finned tube bundles on the other side is L.

Figure 6:
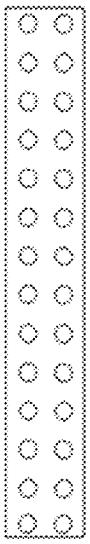
FIG. 6 illustrates an in-line arrangement mode of tube rows in finned tube bundles.
Figure 7:
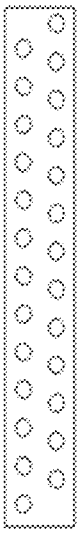
FIG. 7 illustrates a staggered arrangement mode of tube rows in finned tube bundles.

The first finned tube bundle 13 and the second finned tube bundle 14 can be in-line tube bundles as shown in FIG. 6, and can also be staggered tube bundles as shown in FIG. 7, the number of tube rows of a single finned tube bundle is n, wherein 4≥n≥1.

Figure 8:
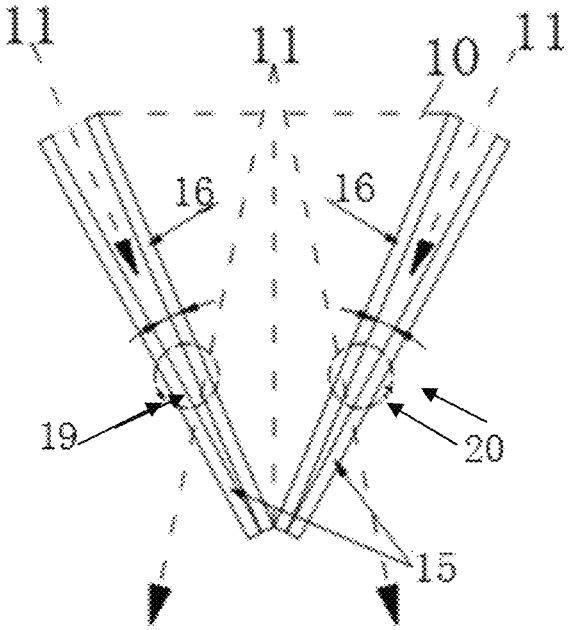
FIG. 8 shows a vertical cooling unit of a dry cooling tower.

Embodiment 1 Application in a cooling delta unit of the dry cooling tower in which the radiator is vertically arranged at the outside of the tower FIG. 8 shows the cross section of one cooling delta unit vertically arranged outside a dry cooling tower. The vertically arranged cooling delta unit is composed of the first novel cooling column 19 and the second novel cooling column 20, which intersect with each other at one side with a set included angle α, wherein the included angle α between the two novel cooling columns is 46°. Each of the first novel cooling column 19 and the second novel cooling column 20 is composed of four columnar cooling tube bundles with wedge-shaped gaps, which columnar cooling tube bundles are connected in series. The columnar cooling tube bundle with the wedge-shaped gap is composed of two finned tube bundles, which intersect at one side and are connected, and each of the two finned tube bundles has 2 tube rows. When the wind speed of the ambient crosswind is 4 m/s, and the wind direction of the crosswind is directed from the sector angle θ=0° to θ=180°, the wedge-shaped included angle β between the two finned tube bundles forming the columnar cooling tube bundle and the distance l of the shared fins are optimized according to the relative position of the cooling delta unit of the dry cooling tower composed of the columnar cooling tube bundles with the wedge-shaped gaps with respect to the ambient crosswind direction:

with respect to the cooling delta unit within the sector angle θ=0°-17° of the dry cooling tower, the wedge-shaped included angle between the two finned tube bundles forming the columnar cooling tube bundle with the wedge-shaped gap is optimized as β=3°, and the distance of the shared fins of the two finned tube bundles is optimized as l=⅛ L;

with respect to the cooling delta unit within the sector angle θ=17°-34° of the dry cooling tower, the wedge-shaped included angle of the columnar cooling tube bundle is optimized as β=4°, and the distance of the shared fins of the two finned tube bundles is optimized as l=⅛ L;

with respect to the cooling delta unit within the sector angle θ=34°-51° of the dry cooling tower, the wedge-shaped included angle of the columnar cooling tube bundle is optimized as β=5°, and the distance of the shared fins of the two finned tube bundles is optimized as l=¼ L;

with respect to the cooling delta unit within the sector angle θ=51°-68° of the dry cooling tower, the wedge-shaped included angle of the columnar cooling tube bundle is optimized as β=6°, and the distance of the shared fins of the two finned tube bundles is optimized as l=¼ L;

with respect to the cooling delta unit within the sector angle θ=68°-85° of the dry cooling tower, the wedge-shaped included angle of the columnar cooling tube bundle is optimized as β=7°, and the distance of the shared fins of the two finned tube bundles is optimized as l=⅜ L;

with respect to the cooling delta unit within the sector angle θ=85°-102° of the dry cooling tower, the wedge-shaped included angle of the columnar cooling tube bundle is optimized as β=8°, and the distance of the shared fins of the two finned tube bundles is optimized as l=⅜ L;

with respect to the cooling delta unit within the sector angle θ=102°-119° of the dry cooling tower, the wedge-shaped included angle of the columnar cooling tube bundle is optimized as β=9°, and the distance of the shared fins of the two finned tube bundles is optimized as l=½ L;

with respect to the cooling delta unit within the sector angle θ=119°-136° of the dry cooling tower, the wedge-shaped included angle of the columnar cooling tube bundle is optimized as β=10°, and the distance of the shared fins of the two finned tube bundles is optimized as l=½ L;

with respect to the cooling delta unit within the sector angle θ=119°-136° of the dry cooling tower, the wedge-shaped included angle of the columnar cooling tube bundle is optimized as β=10°, and the distance of the shared fins of the two finned tube bundles is optimized as l=½ L;

with respect to the cooling delta unit within the sector angle θ=136°-150° of the dry cooling tower, the wedge-shaped included angle of the columnar cooling tube bundle is optimized as β=7°, and the distance of the shared fins of the two finned tube bundles is optimized as l=⅜ L;

with respect to the cooling delta unit within the sector angle θ=150°-165° of the dry cooling tower, the wedge-shaped included angle of the columnar cooling tube bundle is optimized as β=5°, and the distance of the shared fins of the two finned tube bundles is optimized as l=¼ L; and with respect to the cooling delta unit within the sector angle θ=165°-180° of the dry cooling tower, the wedge-shaped included angle of the columnar cooling tube bundle is optimized as β=3°, and the distance of the shared fins of the two finned tube bundles is optimized as l=⅛ L.

The two finned tube bundles of the columnar cooling tube bundle with the wedge-shaped gap respectively form an upstream side tube bundle 15 and a downstream side tube bundle 16 of the first novel cooling column 19 and the second novel cooling column 20; and the upstream side tube bundle 15 is located on the outer side of the cooling unit, and the downstream side tube bundle 16 is located on the inner side of the cooling unit. The first novel cooling column 19 and the second novel cooling column 20 are open on the non-intersecting side to form a main air inlet 10 of the cooling delta unit, and a louver is arranged at the air inlet for adjusting the air input of the cooling unit. The louver is completely opened in summer, and is partially opened or closed in relatively cold seasons.

In addition to entering the cooling delta unit from the main air inlet between the first novel cooling column 19 and the second novel cooling column 20, air 11 also enters the cooling delta unit from the wedge-shaped gap 12 at the end wall of the opening side of the columnar cooling tube bundle forming the cooling column, and the louver is installed at the wedge-shaped gap 12 for adjusting the air input. As can be seen from FIG. 8, the main air inlet of the cooling unit provides the main air flow necessary for cooling the circulating water of the two cooling columns, and the incoming flow air from the wedge-shaped gap 12 at the end wall of the opening side of the columnar cooling tube bundle can function to improve the air flow field structure in the cooling unit and intensify the heat transfer performance of the cooling tube bundle.

In the absence of ambient natural crosswind, the incoming flow air from the wedge-shaped gap 12 of the columnar cooling tube bundle is not subjected to heat exchange by the downstream side tube bundle 16 of the cooling column, and therefore the heat transfer temperature difference between the air and the upstream side tube bundle 15 is greater, the average heat transfer temperature difference of the cooling tube bundle can be improved, and the heat transfer performance of the cooling tube bundle can be intensified.

In the presence of ambient natural crosswind, with respect to the cooling unit at tower lateral, the incoming flow air from the wedge-shaped gap 12 at the end wall of the opening side of the columnar cooling tube bundle that forms the cooling column on one side of the cooling unit can directly impact the inner space of the cooling unit, therefore the low-speed air flow area in the cooling unit at tower lateral can be effectively reduced or even eliminated, and both the cooling performance of the cooling column on one side of the cooling unit and the overall cooling performance of the cooling unit can be improved.

In the presence of ambient crosswind, with respect to the cooling units on a windward side and a leeward side of the dry cooling tower, when air flows into the cooling units, the incoming flow air from the wedge-shaped gap 12 at the end wall of the opening side of the columnar cooling tube bundle can increase the internal ventilation of the cooling tube bundles, amplify the average heat transfer temperature difference between the air and water on the two sides of finned tube bundles, and then intensify the heat transfer performance of the cooling tube bundle.

Figure 9:
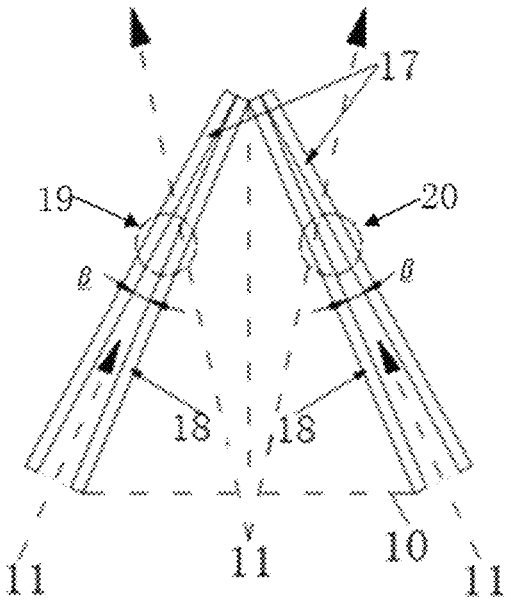
FIG. 9 is a horizontal cooling unit of a dry cooling tower.

Embodiment 2 Application in an A-shaped framework cooling unit of the dry cooling tower in which the radiator is horizontally arranged at the bottom of the tower FIG. 9 shows the horizontally arranged A-shaped framework cooling unit of the dry cooling tower, composed of the first novel cooling column 19 and the second novel cooling column 20, which intersect with each other at one ends to form an included angle $\alpha$ of about 46°. Each of the first novel cooling column 19 and the second novel cooling column 20 is composed of two columnar cooling tube bundles with wedge-shaped gaps, which columnar cooling tube bundles are connected in series. The columnar cooling tube bundle with wedge-shaped gap is composed of two finned tube bundles, which are connected with each other on the top side end walls and each have two tube rows. At the design crosswind speed of 4 m/s, both the wedge-shaped included angle $\beta$ and the distance l of the shared fins should be optimized for the two finned tube bundles in one novel cooling column, according to the relative orientation of the A-shaped framework cooling unit in the dry cooling tower composed of the columnar cooling tube bundle with the wedge-shaped gap, referring to the ambient crosswind direction:

with respect to the A-shaped framework cooling unit within the outer side range of ½ radius of the half tower on the windward side of the dry cooling tower, the wedge-shaped included angle between the two finned tube bundles of the columnar cooling tube bundle with the wedge-shaped gap is optimized as $\beta=7°$, and the distance of the shared fins of the two finned tube bundles is optimized as $l=\frac{1}{4}L$;

with respect to the A-shaped framework cooling unit within the inner side range of ½ radius of the half tower on the windward side of the dry cooling tower, the wedge-shaped included angle between the two finned tube bundles of the columnar cooling tube bundle with the wedge-shaped gap is optimized as $\beta=5°$, and the distance of the shared fins of the two finned tube bundles is optimized as $l=\frac{1}{8}L$;

with respect to the A-shaped framework cooling unit within the outer side range of ½ radius of the half tower on the leeward side of the dry cooling tower, the wedge-shaped included angle between the two finned tube bundles of the columnar cooling tube bundle with the wedge-shaped gap is optimized as $\beta=6°$, and the distance of the shared fins of the two finned tube bundles is optimized as $l=\frac{1}{4}L$; and with respect to the A-shaped framework cooling unit within the inner side range of ½ radius of the half tower on the leeward side of the dry cooling tower, the wedge-shaped included angle between the two finned tube bundles of the columnar cooling tube bundle with the wedge-shaped gap is optimized as $\beta=4°$, and the distance of the shared fins of the two finned tube bundles is optimized as $l=\frac{1}{8}L$.

The two finned tube bundles in the columnar cooling tube bundle respectively form the first single-pass tube bundle 17 and the second single-pass tube bundle 18 of the first novel cooling column 19 and the second novel cooling column 20, the first single-pass tube bundle 17 is located on the outer side, and the second single-pass tube bundle 18 is located on the inner side. The first novel cooling column 19 and the second novel cooling column 20 open on the non-intersecting sides to form a main air inlet 10 of the A-shaped framework cooling unit, and a louver is arranged at the air inlet for adjusting the air input of the cooling unit. The louver is completely opened in summer and is partially opened or closed in relatively cold seasons.

In addition to entering the A-shaped framework cooling unit from the main air inlet between the first novel cooling column 19 and the second novel cooling column 20, air 11 also enters the A-shaped framework cooling unit from the wedge-shaped gap 12 at the end wall of the opening side of the columnar cooling tube bundle forming the cooling column, and the louver is installed at the wedge-shaped gap 12 for adjusting the air input. As can be seen from FIG. 9, the main air inlet 10 of the cooling unit provides the main air flow necessary for cooling the circulating water of the two columnar cooling tube bundles, and the incoming flow air from the wedge-shaped gap 12 at the end wall of the opening side of the columnar cooling tube bundle can function to improve the air flow field structure in the cooling unit and intensify the heat transfer performance of the cooling tube bundle.

The incoming flow air from the wedge-shaped gap 12 at the end wall of the opening side of the columnar cooling tube bundle can avoid the formation of low-speed air eddy in the cooling unit, and can also increase the internal ventilation of the cooling tube bundle, amplify the average heat transfer temperature difference between the air and water on the two sides of finned tube bundles, and then intensify the heat transfer performance of the cooling tube bundle.

According to the columnar cooling tube bundle with the wedge-shaped gap provided by the present invention, the wedge-shaped gap at the end wall of the opening side of the columnar cooling tube bundle can optimize the air inlet area of the cooling unit of the dry cooling tower, effectively reduce the low-speed air eddy area in the cooling unit in the presence of ambient crosswind and avoid lowered cooling performance of the cooling column on one side in the cooling unit. Whereas in the traditional columnar cooling tube bundle of the dry cooling tower, regardless of the presence or absence of the ambient natural crosswind, as no wedge-shaped air inlet is formed in the end wall of the outer side of the cooling column formed by the finned tube bundles, the ambient air always flows by the finned tube bundles in sequence. In contrast, the columnar cooling tube bundle with the wedge-shaped gap provided by the present invention can introduce a part of fresh air into the downstream finned tube bundles and optimize the air flow field structure in the cooling unit. Therefore, the columnar cooling tube bundle with the wedge-shaped gap can effectively increase the average heat transfer temperature difference between air and water on the cooling tube bundle, improve the air flow field structure in the cooling unit, improve both the cooling performance of the cooling column on one side of the cooling unit and the overall cooling performance of the cooling unit, and eventually improve the cooling performance of the dry cooling tower.

Described above are only preferred embodiments of the present invention. It should be noted that numerous improvements and modifications may also be made by those of ordinary skilled in the art without departing from the principle of the present invention, and these improvements and modifications should also be encompassed within the scope of protection of the present invention.

The invention claimed is:

1. A columnar cooling tube structure, comprising:

a first set of two finned tube bundles and a second set of two finned tube bundles, wherein, for each set, the two finned tube bundles intersect with each other at one side and are open at an other side, wherein, for each set, the two finned tube bundles have a set included angle between the two finned tube bundles, wherein, for each set, a wedge-shaped gap is provided between the two finned tube bundles, wherein, for each set, the set included angle between the two finned tube bundles is 0° to 10°, and wherein the first set of the two finned tube bundles are configured to form a first side of a triangular cooling unit and the second set of the two finned tube bundles are configured to form a second side of the triangular cooling unit.

2. The columnar cooling tube structure according to claim 1, wherein, for each set, the two finned tube bundles are symmetrically arranged.

3. The columnar cooling tube structure according to claim 1, wherein, for each set, when the two finned tube bundles are vertically arranged, one of the two finned tube bundles is an upstream side tube bundle, and an other of the two finned tube bundles is a downstream side tube bundle.

4. The columnar cooling tube structure according to claim 1, wherein, for each set, when the two finned tube bundles are horizontally arranged, one of the two finned tube bundles is a first single-pass tube bundle, and an other of the two finned tube bundles is a second single-pass tube bundle.

5. The columnar cooling tube structure according to claim 1, wherein referring to an ambient crosswind speed and a relative position of the cooling unit composed of the columnar cooling tube structure with respect to the ambient crosswind direction, for each set of two finned tube bundles, the set included angle of the two finned tube bundles is 3°, 4°, 5°, 6°, 7°, 8°, 9° or 10°.

6. The columnar cooling tube structure according to claim 1, wherein, for each set, an intersection point between end walls of the two finned tube bundles on an intersection side is an original point, a certain distance l is extended along the two finned tube bundles toward the end walls on the opening side, and a distance from the original point to the end walls of the two finned tube bundles on the opening side is L, and wherein, for each set, the two finned tube bundles share fins within 0-l, and $0<l\leq\frac{1}{2}L$ is satisfied.

7. The columnar cooling tube structure according to claim 6, wherein referring to an ambient crosswind speed and a relative position of the cooling unit composed of the columnar cooling tube structure with respect to the ambient crosswind direction, for each set of the two finned tube bundles, a distance l of shared fins of the two finned tube bundles is ⅛ L, ¼ L, ⅜ L or ½ L.

8. The columnar cooling tube structure according to claim 1, wherein, for each set, tube rows in the two finned tube bundles are arranged in a staggered mode or an in-line mode.

9. The columnar cooling tube structure according to claim 1, wherein, for each set, tube rows in the two finned tube bundles are n rows, wherein $4\geq n\geq 1$, and n is an integer.

* * * * *